United States Patent [19]

Richards

[11] Patent Number: 4,772,071

[45] Date of Patent: Sep. 20, 1988

[54] KNEE PADS

[76] Inventor: Lee E. Richards, 1681 Devine Rd., North Whitfield, Me. 04353

[21] Appl. No.: 40,046

[22] Filed: Apr. 16, 1987

[51] Int. Cl.[4] ..... A47C 7/50

[52] U.S. Cl. ..... 297/423; 2/24; 5/443; 297/4; 297/195; 297/462

[58] Field of Search ..... 297/4, 111, 195, 423, 297/426, 438, 462; 5/443; 2/24

[56] References Cited

U.S. PATENT DOCUMENTS

| | | | |
|---|---|---|---|
| 2,432,565 | 12/1947 | Ferguson | 2/24 |
| 2,480,406 | 8/1949 | Fomey | 297/468 X |
| 2,484,494 | 10/1949 | Ferguson | 2/24 |
| 3,025,526 | 3/1962 | Ramon | 2/24 |
| 3,863,978 | 2/1975 | Gillings, Jr. | 297/195 X |
| 4,377,309 | 3/1983 | Mengshoel | 297/423 |
| 4,589,699 | 5/1986 | Dungan | 297/432 X |

FOREIGN PATENT DOCUMENTS

| | | | |
|---|---|---|---|
| 843232 | 7/1952 | Fed. Rep. of Germany | 2/24 |
| 449588 | 7/1948 | Canada | 297/429 |

*Primary Examiner*—Joseph Falk
*Assistant Examiner*—Peter R. Brown

[57] ABSTRACT

Knee pads which are to be worn while a person is working on a surface in a kneeling position have a first section provided with a first portion to be attached to a lower leg and a knee seat to accommodate the knee cap and the upper portion of the tibia, a second section connected to the first section and having a seat for a buttock and the adjacent portion of the upper leg and a support engageable with the surface when the user is kneeling with body weight transferred to the surface by the knee pad rather than through the knee joint.

12 Claims, 3 Drawing Sheets

10
11
12
13
14
15
17
22
25
26
27
28
29
31
33
33A
34
34A
35
37
38
40
42
43
44
45
45A
4
5

10
11
12
13
14
26
27
33

KNEE PADS

BACKGROUND OF THE INVENTION

Almost everyone is aware of the discomfort that follows a kneeling position maintained for even a short interval. To those whose occupations require working in that position for long intervals, on floors and floor coverings, for example, knee pads are used to minimize such discomfort.

The knee pads presently available for that purpose are concavo-convex to accommodate the knee joint area and are secured to the legs by straps above and below the knee joints. While these provide a cushion for the knee joint area, the straps bind and such knee pads do not avoid the substantial likelihood that the user will suffer such damage to his knees that surgery may be required or a change of occupation necessitated due to the body weight borne by the fully flexed knee or knees.

THE PRESENT INVENTION

The general objective of the present invention is to provide knee pads that will minimize the risk of knee injuries for those who must work in a kneeling position for substantial lengths of time.

This objective is attained with knee pads each of which has a first section attachable to a lower leg and provided with a knee seat accommodative of the upper end of the tibia and a second section connected to the first section and provided with a seat engageable by a buttock and a portion of the associated upper leg when the wearer kneels. Each knee pad also includes a support engageable with the floor or other surface on which the wearer kneels and which has the function of bearing the weight of the wearer's body and thereby avoiding injury-inducing strains on the flexed knee joint.

A preferred feature is that the knee pads be so constructed that not only are the knee joints thus protected but also that the toes of the foot of the held leg are prevented from being flexed by pressure exerted on them on contact of the toe of the shoe on that foot with the underlying surface.

A further preferred feature of the invention is the provision that the support of a knee pad is a part of the first section and preferably adjustable lengthwise thereof and that a separate section is detachably connected to the first and second sections and completes the connection of the first section to the lower leg.

Another objective of the invention is that of avoiding the use of straps in connecting the knee caps to the legs and to that end, sections that are to be detachably interconnected are joined by release pins such as those manufactured by Lockwell Hartwell Company of Los Angeles, Calif., which pins require only a pull to effect their unlocking.

Yet another objective of the invention is to insure that the attached knee pads do not restrict movements of the wearer while working in a kneeling position and is attained by providing that the supports permit the tilting of the knee pads and also by providing that the seat of the second section is free to tilt forwardly and rearwardly.

Other objectives of the invention and the manner of their attainment will be apparent from the following description of a preferred embodiment and the appended claims.

BRIEF DESCRIPTION OF THE DRAWINGS

The accompanying drawings illustrate a preferred embodiment of the invention

THE PREFERRED EMBODIMENT OF THE INVENTION

Figure 2:
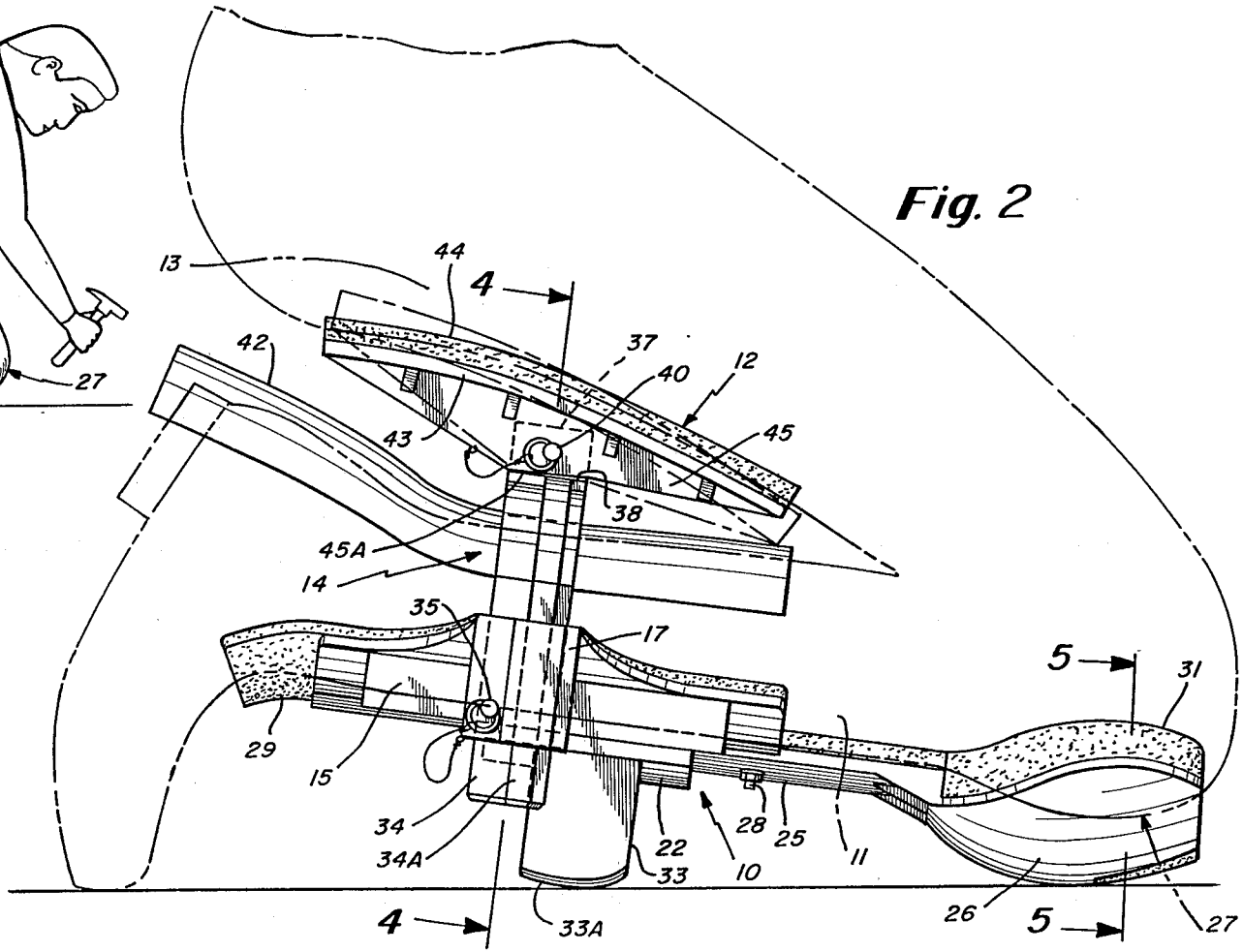
FIG. 2 is a similar view but with the knee pad shown on an increase in scale and with the leg shown in phantom.
Figure 1:
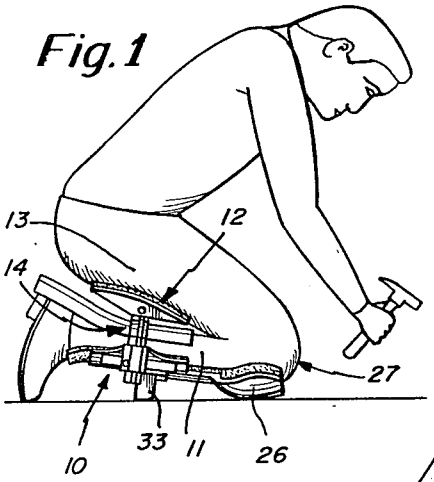
FIG. 1 is a side view of a knee pad in accordance therewith attached to the right leg of a user shown in a typical kneeling position.
Figure 3:
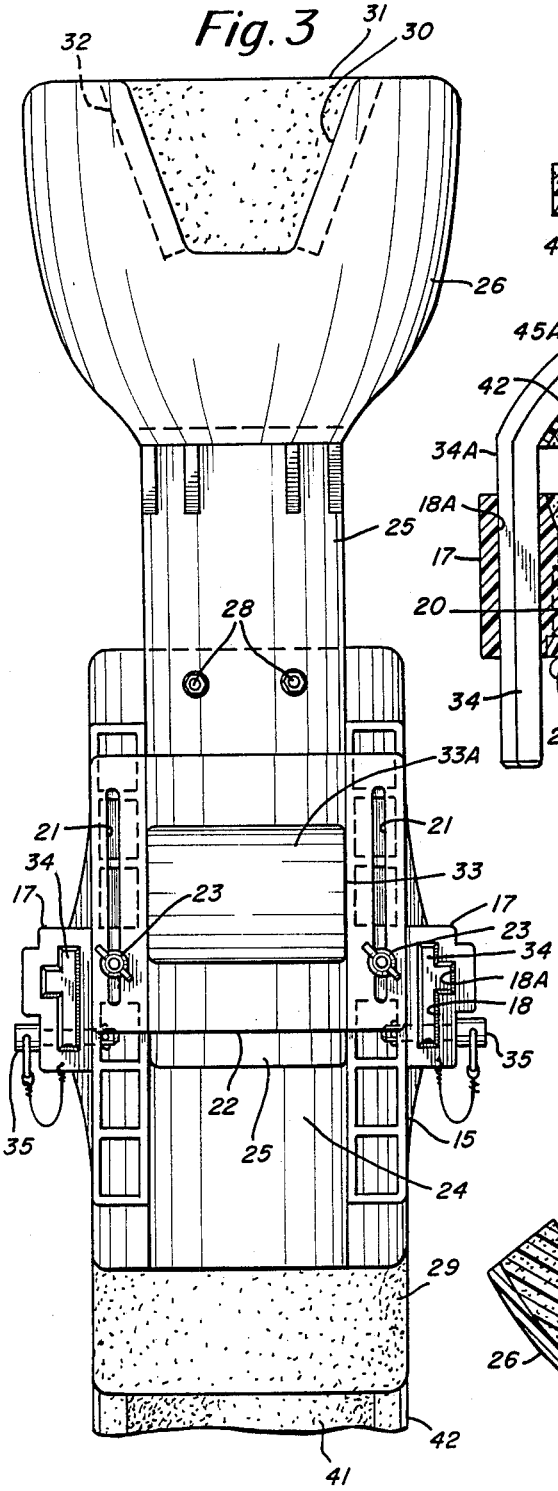
FIG. 3 is a bottom plan view of the knee pad.
Figure 4:
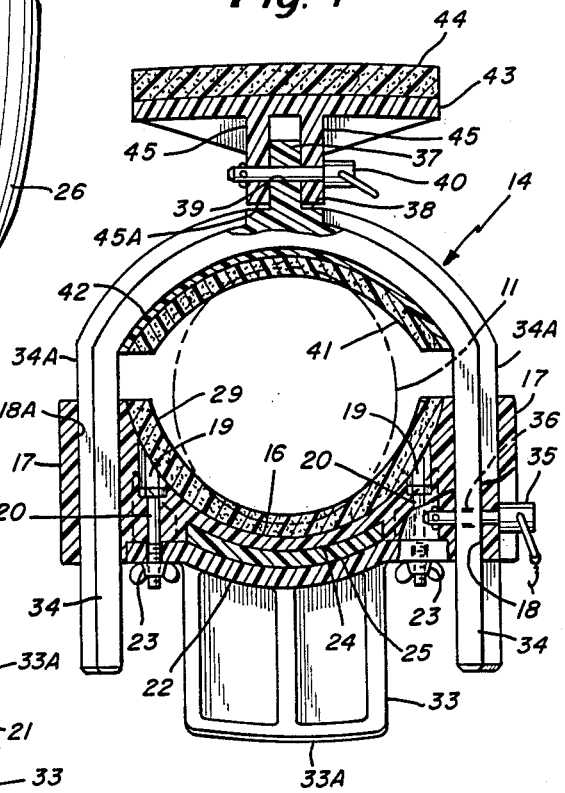
FIG. 4 is a section taken approximately along the indicated line 4—4 of FIG. 2.
Figure 5:
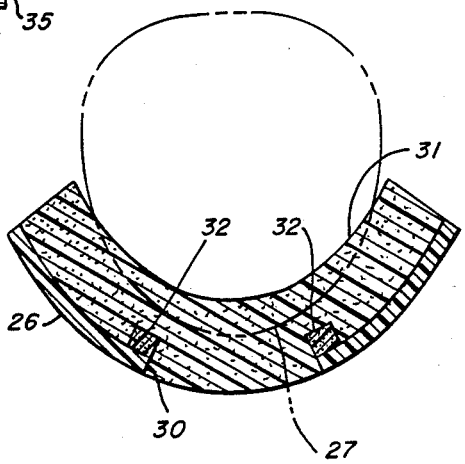
FIG. 5 is a section taken approximately along the indicated line 5—5 of FIG. 2.
Figure 6:
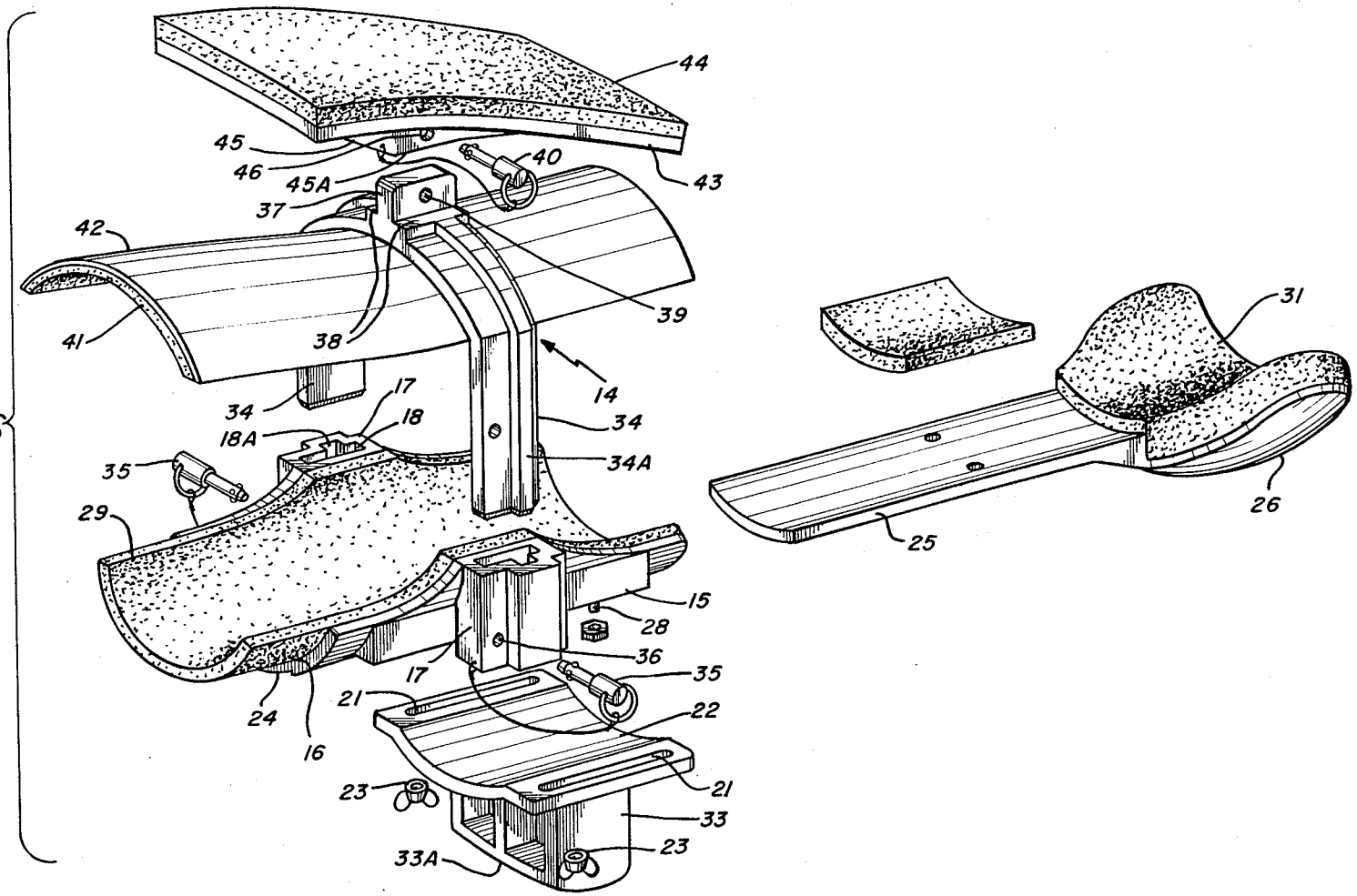
FIG. 6 is an exploded view showing the components of the knee pad in perspective.

The knee pad illustrated by the drawings is one of an identical pair worn by a person whose activities are such that he must work from a kneeling position for substantial time intervals.

The knee pad is shown as consisting of a knee pad section, generally indicated at 10 which also supports a lower leg 11 of the user, a generally indicated section 12 in support of a buttock and his upper leg 13 and a downwardly opening wishbone section generally indicated at 14 detachably connected to the sections 10 and 12.

In more detail, the knee pad section 10 has a mount 15 having a lengthwise arcuate channel 16 between laterally protruding bosses 17 each of which has an upwardly opening slot 18 formed with a narrow pocket 18A and opening through its outside edge. The slots 18 are parallel and extend through the mount 15. The mount 15 also has sockets 19 in the channel 16, one adjacent each boss 17 and receptive of and holding against turning the head of a bolt 20 which extends downwardly through the mount and through the appropriate one of the slots 21 in the co-planar margins of a concave base plate 22 and locked to the mount by wing nuts 23 threaded on the exposed ends of the bolts 20.

There is a convex seat 24 extending lengthwise and centrally of the bottom of the mount 15 which and the base plate 22 form a slideway for the arcuate and resilient tongue 25 of the seat 26 which is generally concave as to its interior and generally convex as to its exterior.

The base plate 22 has transversely spaced holes for bolts 28 but before the tongue 25 is bolted to the base plate, the knee pad section 10 is assembled and fitted to the shin portion of the lower leg and to the knee area. The location of holes in the tongue which are to register with those in the base plate are then marked and after such holes are drilled, the base plate and tongue are bolted together with the assurance that the completed knee pad section will always be a proper fit when worn.

To ensure comfort while a knee pad is being worn, the channel 16 is provided with a layer of suitable cushioning material 29 which preferably so extends beyond the mount 15 as to underlie the ankle when the knee pad is attached.

The knee seat 26 is formed with a central gap 30 in its front and is provided with a cushioning layer 31 overlying the gap and lengths 32 of a denser cushioning material which border the gap in a position to engage the upper end of the tibia laterally of the central position thereof.

The base plate 22 also includes a pivot block 33 which has a convex, floor engaging surface 33A and it may be moved forwardly and rearwardly relative to the mount 16 as the bolts 21 carried by the latter each extend through lengthwise slots 21 in the former.

The mount 15 is secured to a lower leg 11 by means of the wishbone section 14 the arms 34 of which have straight parallel ends and lengthwise ribs 34A for slidable entry into the slots 19 and their pockets. Each arm 34 is anchored to the appropriate one of the bosses 17 by means of a pin 35 when inserted through a registering hole 36 in the arms and bosses. The holes in the arms 34 preferably are drilled after their correct location is established by assembling the mount and wishbone about a leg of the user. The pins 35 are desirably and as shown connected to the bosses 17 by lanyards.

Centrally of the closed end of the wishbone section 14 there is a lengthwise keel or fin 37 bordered by and protruding from co-planar shoulders 38. In order that the section 13 by which the upper leg and the weight of the user's body is supported may be connected to the wishbone section 15, the keel 37 has an aperture 39 dimensioned to receive a pin 40. The wishbone has a length of cushioning material 44 backed by a stiffener 42 both of such length as to engage the floor when the wearer stands, then to push the knee pad section into its proper position if it has slipped downwardly therefrom.

The section 12 includes a support 43 which is lengthwise slightly convex, and provided with a cushoning layer 44 and a pair of depending, centrally located flanges 45 which are spaced apart to receive the keel 37 between them. The flanges 45 have transversely aligned holes 46 midway between their ends through which the pin 40 extends when the aperture 39 is in registry therewith. The pin 40 is connected to one of the flanges 45 by a lanyard.

The flanges 45 taper forwardly and rearwardly towards the corresponding ends of the support 43. Limited pivoting of the support is permitted by providing the flanges 45 with a central flat portion 45A the front ends of which on assembly of the knee pad, seat against the shoulders 38 to limit forward tilting of the support 43 from a rearward limit established when the rear ends of the flat portions 45A bear against the shoulders 38.

From the foregoing, it will be appreciated that the connection of the sections 11 and 15 is easily and securely effected by means of the pins 35 which are easily withdrawn to permit them to be disconnected. The connection of the section 13 to the section 15 by the pin 40 affords like advantages. Once the knee seat 26 has been properly spaced from the mount 16 and the ends of the wishbone arms 34 have had the pin-receiving holes drilled in the correct location, the knee pad, when worn, ensures comfort to the wearer while working in a kneeling position without the risk of causing damage to the knee joint or stressing the toes.

I claim:

1. A knee pad attachable to a leg of a person when working on a surface in a kneeling position, said knee pad including a first section having a forward knee seat and a rearward portion shaped and dimensioned to receive the shin portion of said leg, a second section including a U-shaped portion to straddle the received leg, means detachably connecting the ends of the U-shaped portion to the first section, said second section including a buttocks support and one of said sections including a member engageable with the surface when the person is kneeling thereon and then transmitting thereto a substantial percentage of the weight of said person without said weight affecting the flexed knee and the lower leg, said member so dimensioned and disposed that, when said person is kneeling, the first section is forwardly and downwardly inclined with the knee seat resting on the surface and the shoe on the held lower leg so positioned that the toes are not under flexing pressure.

2. The knee pad of claim 1 in which the member is a part of the first section.

3. The knee pad of claim 1 in which the supporting member is a pivot block.

4. The knee pad of claim 3 in which the first section includes a resiliently yieldable tongue between the knee seat and the rearward portion.

5. The knee pad of claim 1 in which the knee seat is concave and shaped, dimensioned and so positioned that the zone of contact of the knee seat with the surface underlies the tibia close to the knee cap.

6. The knee pad of claim 5 in which the knee seat has a gap forwardly of the zone of contact which is so dimensioned as to underlie the lower portion of the knee cap and a layer of cushioning material lines the knee seat and overlies the gap.

7. The knee pad of claim 6 in which the knee seat has a pair of cushioning members which are more rigid than said cushioning, one member adjacent each side of the gap and are spaced apart to receive between them the central portion of the tibia at the knee joint end thereof.

8. The knee pad of claim 1 in which the means connecting the sections includes a member of a length such as to extend to the surface when the person wearing the knee pad is standing, said member being sufficiently flexible to fit against portions of the lower leg and sufficiently rigid to serve as a gauge establishing the proper position of the knee pad.

9. The knee pad of claim 1 in which the detachable connecting means include slideways, one on each side of the rearward portion of the first section positioned and dimensioned to receive the free ends of the U-shaped portion and connections of a quick release type connect the received ends to said slideways.

10. The knee pad of claim 1 and means pivotally connect the buttocks support to the U-shaped portion to enable the support to tilt forwardly and rearwardly and the connecting means also includes means to limit the extent to which such tilting is permitted.

11. The knee pad of claim 1 in which there is a lengthwise fin centrally of the closed end of the U-shaped portion, a shoulder borders the base of the fin, the second section includes a depending flange, a transverse pivot of the quick release type detachably connects the fin to the second section, said flange having a portion so positioned relative to the shoulder that the rear of the last named portion engages the rear of the shoulder as a stop limiting rearward tilting and the first of said portions is engageable with the front of the shoulder to limit foward tilting.

12. The knee pad of claim 10 in which the connecting means includes transverse pin of a quick release type.

* * * * *